US005188403A

United States Patent [19]

Anderson

[11] Patent Number: 5,188,403

[45] Date of Patent: Feb. 23, 1993

[54] CATCH FOR DOOR LATCH

[75] Inventor: John P. Anderson, Norco, Calif.

[73] Assignee: The Hartwell Corporation, Placentia, Calif.

[21] Appl. No.: 692,205

[22] Filed: Apr. 26, 1991

[51] Int. Cl.[5] ..... E05C 19/02

[52] U.S. Cl. ..... 292/17; 292/91; 292/DIG. 38

[58] Field of Search ..... 292/17, 19, 20, 80, 292/86, 87, 88, 89, 91, 76, 77, DIG. 15, DIG. 38

[56] References Cited

U.S. PATENT DOCUMENTS

| | | | |
|---|---|---|---|
| 538,305 | 4/1895 | Wait | 292/76 |
| 627,432 | 6/1899 | Mallory | 292/17 |
| 925,936 | 6/1909 | Moon | 292/76 |
| 1,830,415 | 11/1931 | Wittenberg | 292/76 |
| 2,151,284 | 3/1939 | Tinnerman | 292/76 |
| 2,185,503 | 1/1940 | Fryer | 292/76 |
| 2,303,854 | 12/1942 | Lyon | 292/76 |
| 3,133,757 | 5/1964 | James | 292/75 |
| 3,476,426 | 11/1969 | Lewin | 292/76 |
| 3,776,580 | 12/1973 | Michael | 292/17 |
| 3,988,808 | 11/1976 | Poe et al. | 24/73 P |
| 4,056,275 | 11/1977 | Keeler, II | 292/17 |

OTHER PUBLICATIONS

Catalog sheet 23 showing a variety of catches with multiple parts including the magnetic catch and the lower catch discussed under Backgound of the Invention, 1 sht. "Catches" no date.

Hartwell Nylatch Catch No. 9, two pages Aug. 1974.

Hartwell Nylatch Catch No. 137, Jun. 19, 1975 1 sheet "Nylatch ®".

Hartwell Nylatch Catch HNC-8, Aug. 1, 1983 2 shts "Nylatch Catch".

Hartwell Nylatch Bullet Catch No. 132 Jun. 19, 1975 1 sht.

*Primary Examiner*—Richard E. Moore

*Attorney, Agent, or Firm*—Harris, Kern, Wallen & Tinsley

[57] ABSTRACT

A catch for a door latch or the like for use with a strike for latching a door. The catch is formed of a single piece, typically a molding or a stamping, with a base for mounting at a door or door frame, a lever fixed to the base, and a tang carried on the lever. The tang has a normal position and a latching position with the lever functioning as a spring to urge the tang to the normal position, and with the tang being deflectable to the latching position for passing over a ramp of a strike.

5 Claims, 6 Drawing Sheets

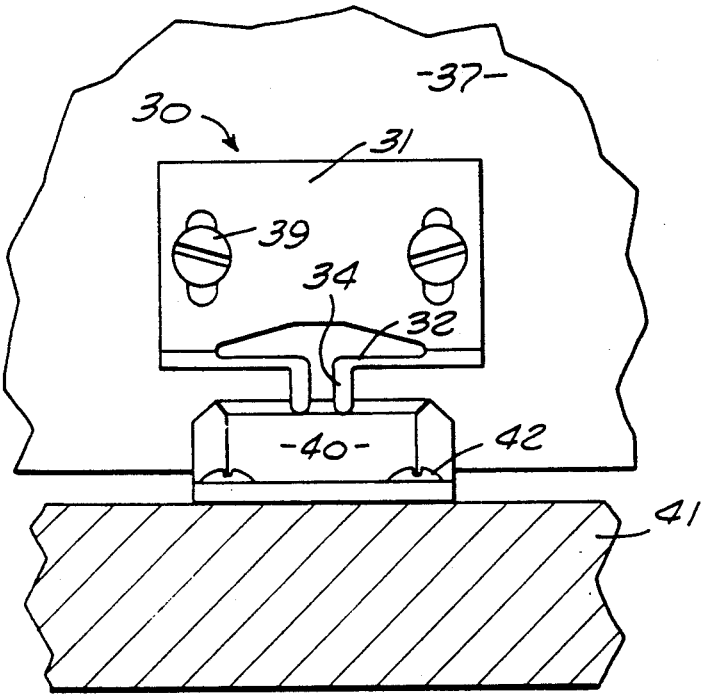
FIG. 10
FIG. 11
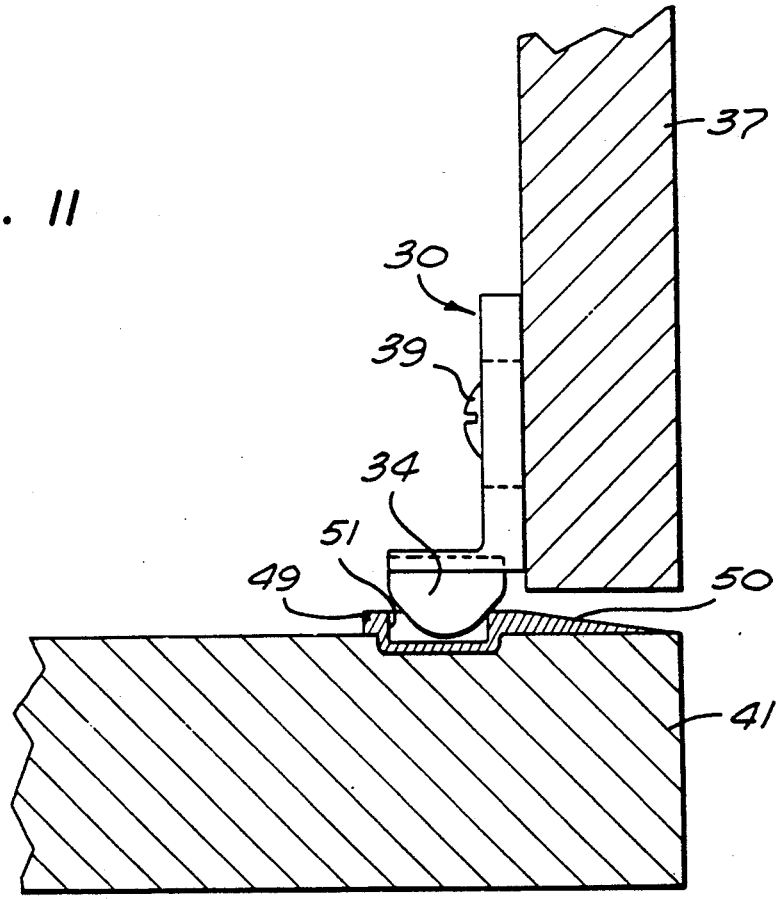

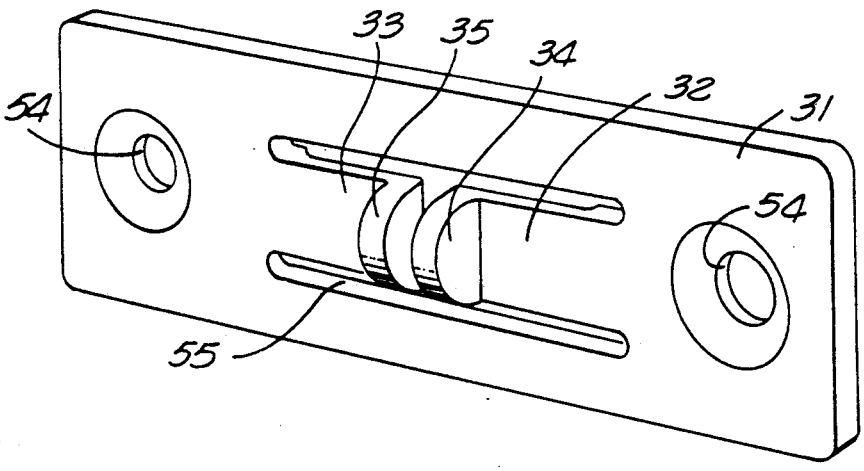
FIG. 12
FIG. 13
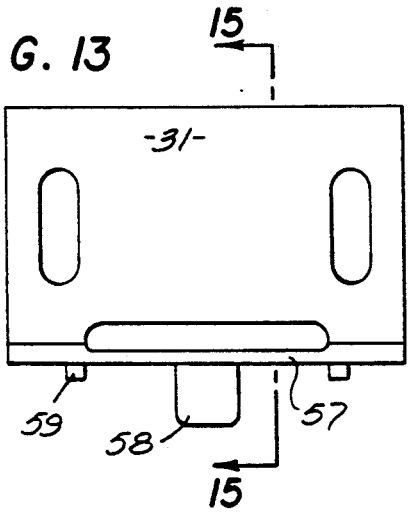
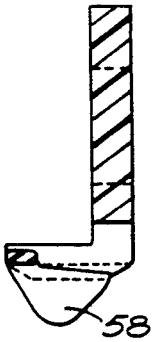
FIG. 15
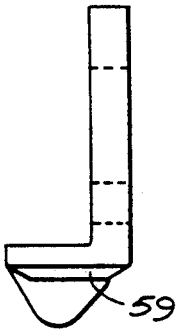
FIG. 16
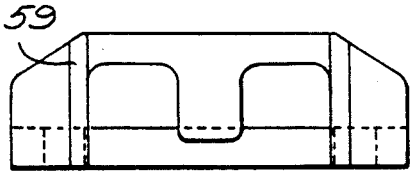
FIG. 14
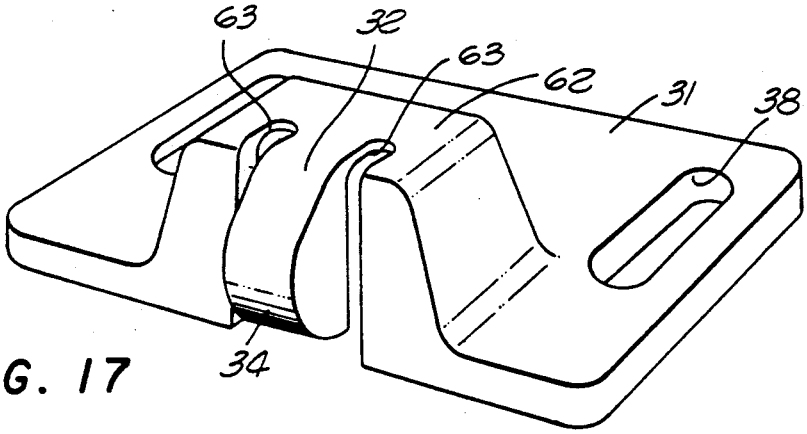
FIG. 17

CATCH FOR DOOR LATCH

BACKGROUND OF THE INVENTION

This invention relates to latches for use on doors and the like, typically kitchen cabinets and storage cabinets which do not require a positive locking feature. The conventional latch has a catch and a strike or striker plate, with the catch being mounted on the door or the door frame and the strike being mounted on the other component.

The typical prior art catch has a roller or tang for engaging the strike, and is made of a plurality of components comprising a base or frame, a roller or ball, a roller carrier, and a spring.

The use of multiple components and moving parts in such a catch make the catch relatively expensive requiring production and handling of a plurality of components and assembly of the components to produce the fininshed catch.

Another type of latch presently in use utilizes a magnet and a keeper. Here again the catch which carries the magnet is a multiple component assembly. Also, the magnetic material itself is more expensive than the plastic or metal used in non-magnetic devices.

SUMMARY OF THE INVENTION

It is an object of the present invention to provide a new and improved catch design which can be made as a single piece by molding or by stamping. A further object of the invention is to provide such a catch which may be produced in various configurations and which may be used with various shapes of strikes. Other objects, advantages, features and results will more fully appear in the course of the following description.

The presently preferred embodiment for the catch of the invention comprises a single piece having a base for mounting at a door or door frame, a lever fixed to the base, and a tang carried on the lever and having a normal position and a latching position. The lever functions as a spring urging the tang to the normal position, with the tang being deflectable to the latching position for passing a ramp of a strike.

BRIEF DESCRIPTION OF THE DRAWINGS

FIG. 10 is a view similar to that of FIG. 8 showing the door in the latched position;

FIG. 11 is a view similar to that of FIG. 9 showing an alternative form of strike;

FIG. 12 is a perspective view of an alternative embodiment of the catch of the invention;

FIG. 13 is a top view of another alternative embodiment of the catch;

FIG. 14 is a front view of the catch of FIG. 13;

FIG. 15 is a sectional view taken along the line 15—15 of FIG. 13;

FIG. 16 is a side view similar to that of FIG. 15 showing the tang in the deflected condition;

FIG. 17 is a perspective view of another alternative embodiment of the invention;

DESCRIPTION OF THE PREFERRED EMBODIMENTS

The catch 30 of FIGS. 1–5 includes a base 31, levers 32, 33 fixed to the base, and tangs 34, 35 carried on the respective levers 32, 33. The catch preferably is injection molded from plastic as a single unitary piece. However it can also be produced of metal by casting or other forming processes.

In an alternative embodiment, a single lever and tang may be used.

Figure 1:
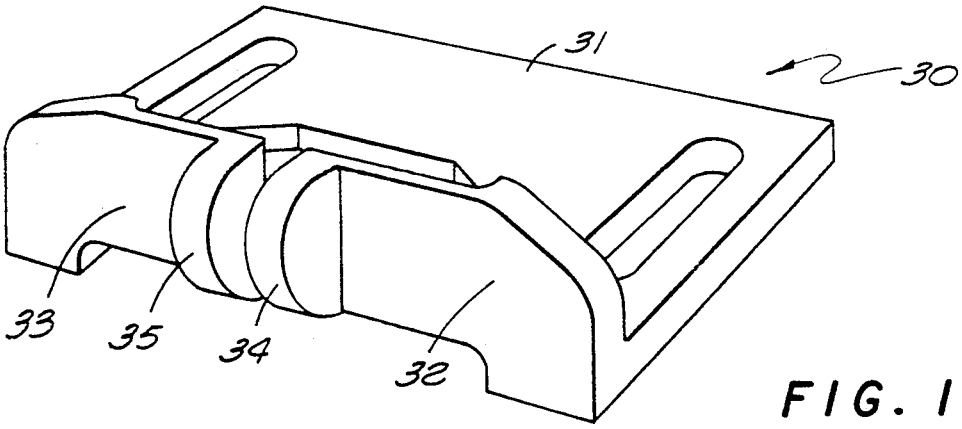
FIG. 1 is a perspective view of a catch incorporating the presently preferred embodiment of the invention.
Figure 5:
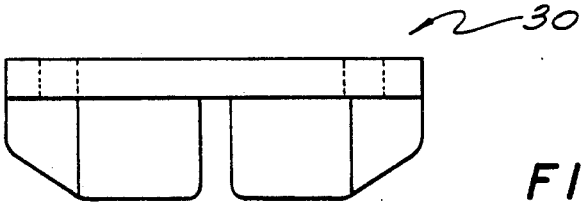
FIG. 5 is a rear view of the catch of FIG. 1.
Figure 2:
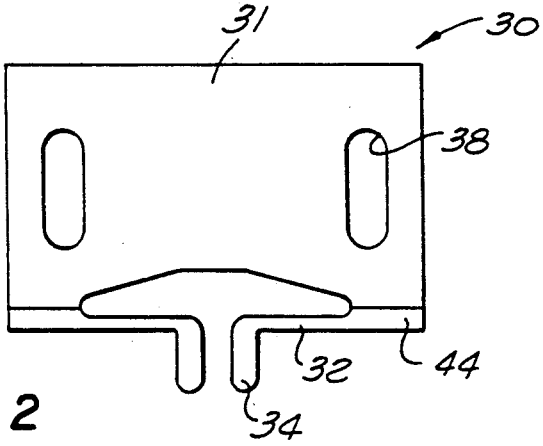
FIG. 2 is a top view of the catch of FIG. 1.
Figure 4:
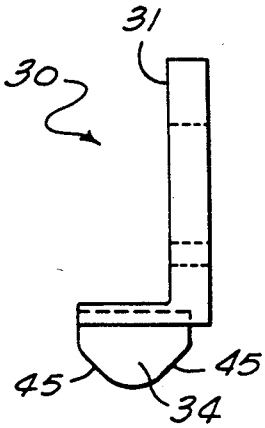
FIG. 4 is a side view of the catch of FIG. 1.
Figure 3:
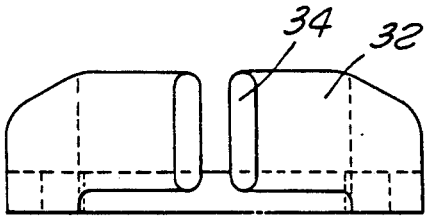
FIG. 3 is a front view of the catch of FIG. 1.
Figure 6:
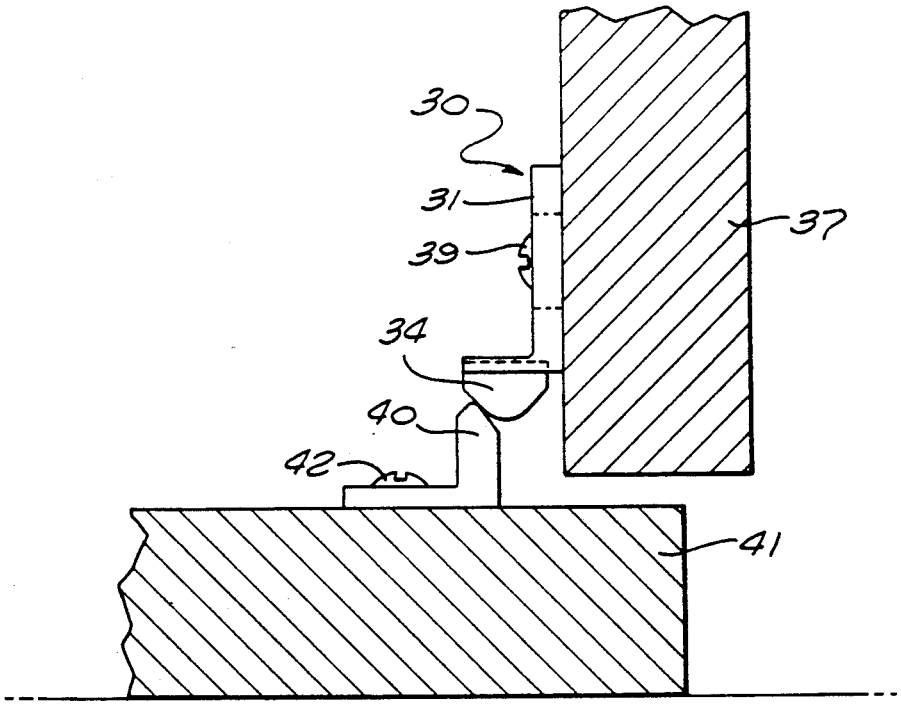
FIG. 6 is a partial sectional view showing the catch of FIG. 1 mounted on a door, with the door in the opened or unlatched position.

In this embodiment, the base 31 is designed for mounting against a door 37 with slots 38 in the base for mounting screws 39, as shown in FIG. 6. A conventional strike 40 is mounted on a door frame 41 by screws 42. Alternatively, the catch may be mounted on the frame and the strike may be mounted on the door.

In the embodiment of FIGS. 1–5, the lever 32 is mounted at one end to an upturned edge 44 of the base, with the tang 34 at the other end of the lever. When two tangs are utilized, the two levers are in the same plane and the two tangs are in spaced parallel arrangement. The tangs preferably have a ramp 45 at the leading and trailing edges, for ease of passing over the strike. The strike 40 as shown in FIG. 6 has corresponding ramps.

Figure 7:
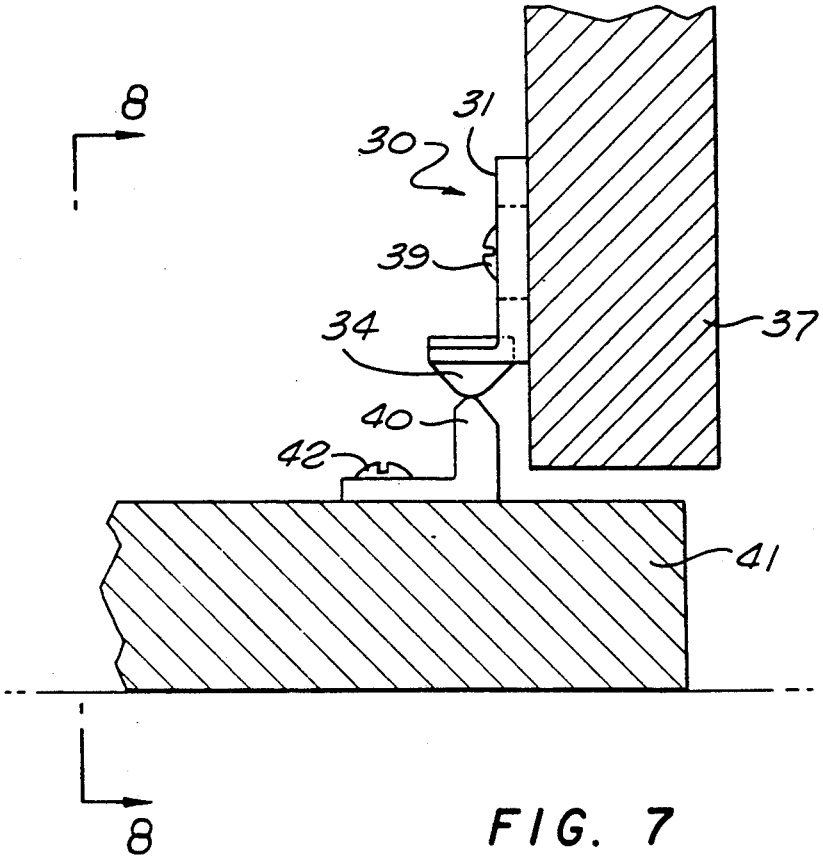
FIG. 7 is a view similar to that of FIG. 6 showing the door between the unlatched and latched positions with the tang deflected to the latching position.
Figure 8:
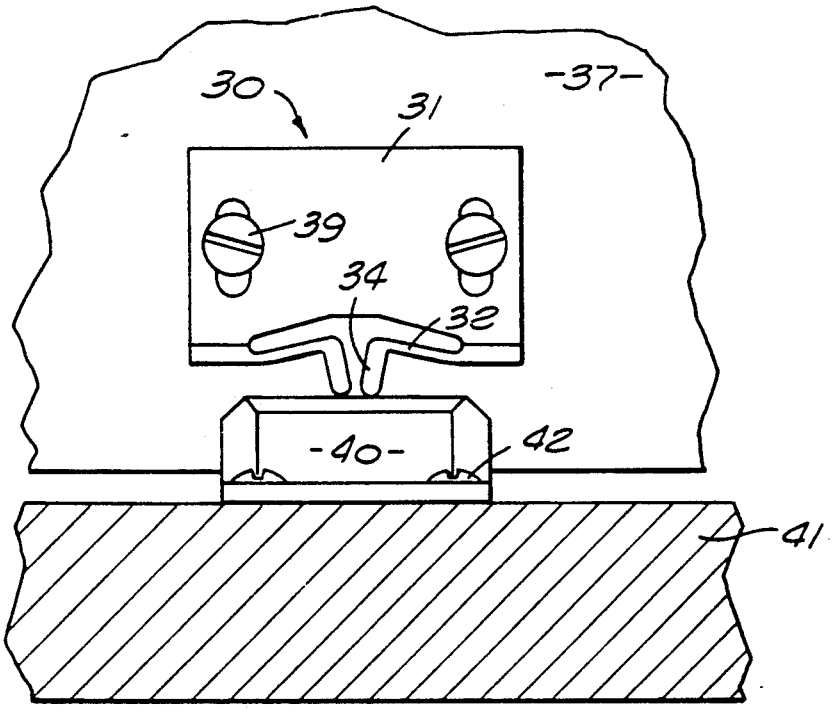
FIG. 8 is a view taken along the line 8—8 of FIG. 7.

The tangs are shown in their normal position in FIG. 6. As the door moves from the unlatched position of FIG. 6 toward the latched position of FIG. 9, the tang 34 rides up on the strike 40, as shown in FIG. 7, deflecting the tang upward, as viewed in FIGS. 6, 7 and 9, to a latching position as shown in FIG. 7. As the door moves onward to the latched position, the tang moves past the strike and returns to its normal position, as shown in FIG. 9, latching the door in the closed or latched position.

Figure 9:
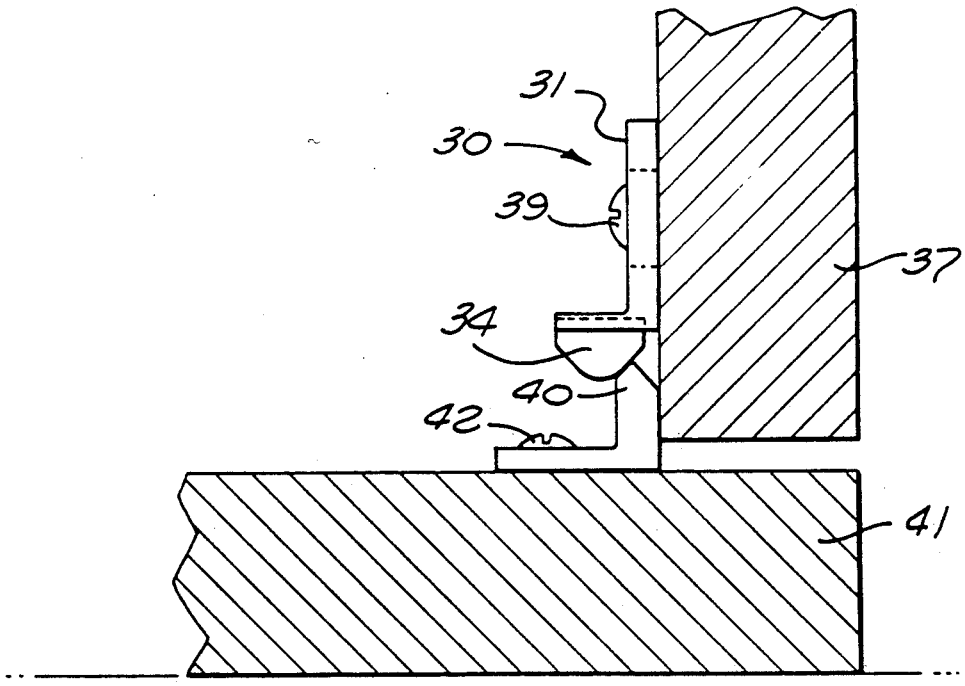
FIG. 9 is a view similar to that of FIGS. 6 and 7 showing the door in the latched position.

The same action occurrs when the door is opened from the closed position of FIG. 9 to the opened position of FIG. 6, with the tang again being deflected upward in order to pass over the strike. In the closing and opening operations, the lever functions as a spring which urges the tang to its normal position, with the strike causing deflection of the tang from its normal position to its latching position both in the closing and opening operations.

An alternative form of strike 49 is shown in FIG. 11, with the strike partially set in the frame, and having a ramp 50 leading to an opening 51 in the strike. The door closing and opening operations are the same for this embodiment as in the previously described embodiment.

An alternative embodiment for the catch is shown in FIG. 12, with the levers 32, 33 coplanar with the base 31. This catch can be mounted against a door or mortised into the door, and has mounting openings 54 for attachment. The levers 32, 33 are coplanar with the base and are formed by an H shaped slot in the base. In an alternative construction using only a single lever and tang, these can be made by a U shaped slot.

In the alternative embodiment of FIGS. 13–16, a single lever 57 is mounted to the base at each end of the lever, with a tang 58 carried on the lever intermediate the lever ends. In this configuration, the lever is a cross beam which acts like a torsion spring when the tang is deflected, in contrast to the previous embodiments wherein the lever functions as a cantilever spring. In FIG. 15, the tang 58 is shown in the normal position, while in FIG. 16 it is shown deflected to the latching position. Ribs 59 may be formed on the upturned edge of the base for improved strength if desired.

In the alternative embodiment of FIG. 17, the base 31 has an upper level 62 spaced upward from the main portion of the base. The lever 32 is fixed to the base at the upper level, preferably between slots 63, with the tang 34 carried at the outer end of the lever.

Figure 18:
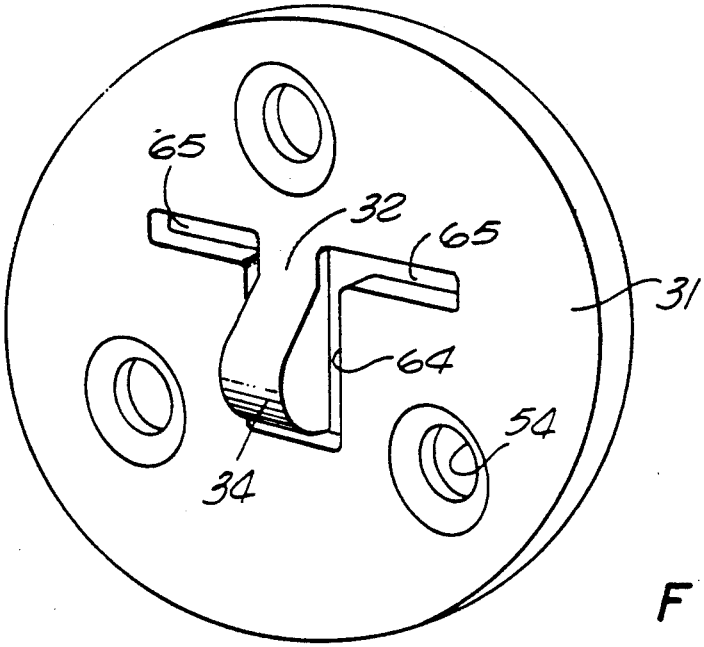
FIG. 18 is a perspective view of another alternative embodiment of the invention.

In the embodiment of FIG. 18, the base 31 is circular and may be mounted against or mortised into the door, with mounting openings 54 for screws. The lever 32 is in the plane of the base 31, with the lever and tang defined by a U shaped slot 64 which may have outwardly directed portions 65.

Figure 19:
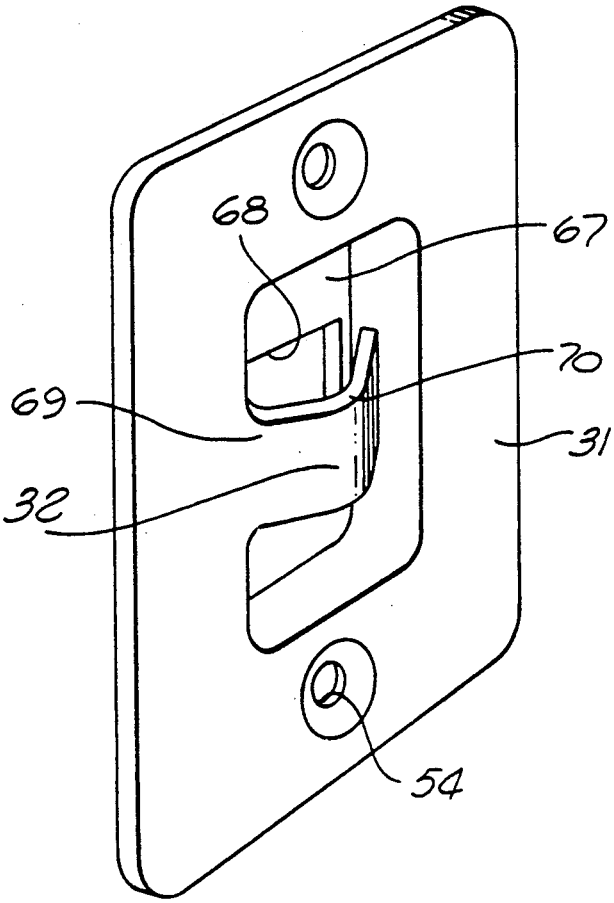
FIG. 19 is a perspective view of another alternative embodiment of the invention.

The embodiment illustrated in FIG. 19 has a depressed section 67 in the base 31, with the lever 32 formed by a U shaped opening 68 in the depressed section. The lever 32 is bent out of the plane of the base 31 at the junction 69 of the lever with the base and is then bent in the opposite direction at a location 70 along the lever thereby forming the tang integral with the lever. In an alternative arrangement, the depressed section 67 may be omitted resulting in a larger U shaped opening in the base.

All of the embodiments described and illustrated are made as a single piece, and all operate in the same manner with the tang being moved from its normal position to a deflected position as the tang passes the projecting portion of the strike moving from the door opened to door closed position and from the door closed position to the door opened position.

I claim:

1. A catch for a door latch or the like for use with a strike for latching a door, said catch comprising a single piece having a planar base for mounting at a door or door frame, with first and second perpendicular axes in the plane of said base, a lever fixed to said base, with said lever projecting from said base perpendicular to said plane of said base and parallel to said first axis, and a tang carried on said lever and having a normal position and a latching position, with said tang projecting from said lever perpendicular to said plane of said base and parallel to said second axis, with said lever urging said tang to said normal position and with said tang deflectable to said latching position for passing a ramp of a strike, and with said lever having first and second ends, with said first end of said lever carried at said base and with said tang carried at said second end of said lever.

2. A catch as defined in claim 1 having another lever fixed to said base and in the same plane as said one lever, and having another tang carried on said other lever, with said tangs in spaced parallel arrangement.

3. A catch as defined in claim 1 wherein said tang has a leading edge and a trailing edge, with each edge having a ramp for passing over a strike to deflect the tang.

4. A catch for a door latch or the like for use with a strike for latching a door, said catch comprising a single piece having a base for mounting at a door or door frame, a lever fixed to said base, a tang carried on said lever and having a normal position and a latching position, with said lever urging said tang to said normal position and with said tang deflectable to said latching position for passing a ramp of a strike, and with said lever and base coplanar, and another lever fixed to said base and aligned with said one lever, with said levers defined by an H shaped slot in said base.

5. A catch for a door latch or the like for use with a strike for latching a door, said catch comprising a single piece having a base for mounting at a door or door frame, a lever fixed to said base, and a tang carried on said lever and having a normal position and a latching position, with said lever urging said tang to said normal position and with said tang deflectable to said latching position for passing a ramp of a strike, and with said base having first and second levels, with said first level having means for attachment to a door or door frame, with said lever fixed to said base second level, and with said tang positioned intermediate said levels.

* * * * *